US009132927B1

(12) United States Patent
Larson

(10) Patent No.: US 9,132,927 B1
(45) Date of Patent: Sep. 15, 2015

(54) BOTTLE AND SYRINGE GUIDE HOLDER SYSTEMS

(71) Applicant: Warren Larson, De Moines, WA (US)

(72) Inventor: Warren Larson, De Moines, WA (US)

( * ) Notice: Subject to any disclaimer, the term of this patent is extended or adjusted under 35 U.S.C. 154(b) by 0 days.

(21) Appl. No.: 13/778,459

(22) Filed: Feb. 27, 2013

Related U.S. Application Data

(60) Provisional application No. 61/603,499, filed on Feb. 27, 2012.

(51) Int. Cl.
*A61M 5/32* (2006.01)
*B65B 3/00* (2006.01)

(52) U.S. Cl.
CPC ..... *B65B 3/003* (2013.01)

(58) Field of Classification Search
CPC ..... B65B 3/003
USPC ..... 604/533, 414; 206/363–366, 370, 168
See application file for complete search history.

(56) References Cited

U.S. PATENT DOCUMENTS

| | | | | |
|---|---|---|---|---|
| 2,122,722 | A * | 7/1938 | O'Neill | 604/414 |
| 3,853,158 | A * | 12/1974 | Whitty | 141/27 |
| 5,279,582 | A | 1/1994 | Davison et al. | |
| 5,487,738 | A * | 1/1996 | Sciulli | 604/414 |
| 5,876,380 | A | 3/1999 | Manganini et al. | |
| 5,894,870 | A * | 4/1999 | Maxwell | 141/27 |

* cited by examiner

*Primary Examiner* — Edelmira Bosques
*Assistant Examiner* — Bradley G Thomas, Jr.
(74) *Attorney, Agent, or Firm* — RG Patent Consulting, LLC; Rachel Gilboy

(57) ABSTRACT

An assistive device that couples a syringe and medicine bottle primarily for use by diabetics as a means of securing the syringe when sliding the bottle up to meet the syringe tip in order to fill the syringe with insulin, and then slide the bottle back out. The insulin may then be given as a shot to a patient.

1 Claim, 5 Drawing Sheets

BOTTLE AND SYRINGE GUIDE HOLDER SYSTEMS

CROSS-REFERENCE TO RELATED APPLICATION

The present application is related to and claims priority from prior provisional application Ser. No. 61/603,499, filed Feb. 27, 2012 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

The following includes information that may be useful in understanding the present invention(s). It is not an admission that any of the information provided herein is prior art, or material, to the presently described or claimed inventions, or that any publication or document that is specifically or implicitly referenced is prior art.

BACKGROUND OF THE INVENTION

1. Field of the Invention

The present invention relates generally to the field of medical devices and more specifically relates to a bottle and syringe guide holder system, an assistive device that is designed to conveniently couple a syringe and medicine bottle. The device is primarily for use by diabetics as a means of securing the syringe when sliding the bottle up to meet the syringe tip in order to fill it with insulin, and then sliding the bottle back out; the process requiring a minimum of dexterity.

2. Description of the Related Art

Many individuals have infirmities. Diabetes is one such infirmity. Diabetes affects more than 23 million people nationwide at an annual health-care cost of over $100 million. A disorder in the body's ability to use blood sugar or glucose, which is the main source of energy for the human body, diabetes can also be a serious risk factor for various forms of cardiovascular disease. The most essential element in fighting the detrimental effects of diabetes is insulin. Secreted by the pancreas, insulin is a natural hormone that is required by the body's cells in order to remove and utilize glucose from the blood. Glucose provides the energy cells need to carry out their many functions and without insulin, the system fails.

Those who suffer from diabetes lack the ability to acquire and utilize the glucose in the blood, thus causing their glucose levels to rise. For those who have type 1 diabetes, their pancreas cannot produce enough insulin and thus additional insulin therapy is required. Those who suffer type 2 diabetes do indeed produce insulin, but their cells simply do not respond properly to the insulin. As such, insulin also may be utilized by those who suffer type 2 diabetes to overcome the resistance of the cells to insulin. By reducing the concentration of glucose in the blood cells and increasing the uptake of this glucose, the administration of insult can prevent or reduce the long-term complications of diabetes, including damage to the blood vessels, eyes, kidneys, and nerves.

In order to administer insulin, most diabetics have to utilize a syringe to extract the insulin from a small glass vial. The top of the vial typically is covered with a rubber gasket and retaining ring, through the center of which the user plunges the syringe's needle in order to extract the proper amount of medication needed to treat their symptoms. While this process may sound relatively simple, many diabetics encounter challenges when attempting to use a syringe and insulin vial. Specifically, for those who suffer limited mobility, tremors brought on by illness or age, or even suffer poor eyesight, it can be extremely challenging to complete this process. As can be imagined, holding an insulin vial in one, unsteady hand, and attempting to pierce it with a sharpened need with the other can result in the user hitting the metal banding that surrounds the rubber gasket, breaking the needle point and resulting in the costly waste of an expensive syringe. In worse case scenarios, the user may jab their own hand or fingers with the needle, causing serious pain and injury.

Various attempts have been made to solve the above-mentioned problems such as those found in U.S. Pat. No. 5,876,380 to Steven J. Manganini et al; U.S. Pat. No. 5,279,582 to Thomas R Davison et al; and U.S. Pat. No. 2,122,722 to John A. O Neill et al. This art is representative of assistive devices. None of the above inventions and patents, taken either singly or in combination, is seen to describe the invention as claimed.

Ideally, an assistive device should be user-friendly and, yet would operate reliably and be manufactured at a modest expense. Thus, a need exists for a reliable assistive device that couples a syringe and medicine bottle primarily for use by diabetics as a means of securing the syringe when sliding the bottle up to meet the syringe tip in order to fill it with insulin, and then sliding the bottle back out and thereby avoiding the above-mentioned problems.

BRIEF SUMMARY OF THE INVENTION

In view of the foregoing disadvantages inherent in the known assistive device art, the present invention provides a novel bottle and syringe guide holder system. The general purpose of the present invention, which will be described subsequently in greater detail is to provide an effective and convenient device and method (means) to fill a syringe with insulin.

A bottle and syringe guide holder system is disclosed herein, in a preferred embodiment, comprising a bottle and syringe guide holder housing. The bottle and syringe guide holder housing comprises a molded cavity having an open-ended half-cylindrical niche; a syringe holder cavity; a medicine bottle holder guide; and a medicine bottle neck clearance. The bottle and syringe guide holder housing comprises clear acrylic in preferred embodiments. The bottle and syringe guide holder housing has the general appearance of a ½ of a mold.

The bottle and syringe guide holder housing, as previously mentioned, comprises the molded cavity. The molded cavity comprises a formed indentation to hold secure a syringe-side-volume of a syringe, and a bottle-side-volume of a medicine bottle, the syringe, and the medicine bottle able to be set into the formed indentation to be temporarily held in stasis. The open-ended half-cylindrical niche is sized to allow a standard inverted insulin vial (or other) to be slid in at one end, while an opposite end accommodates a needle of the syringe to be inserted into the insulin vial (insulin vial comprising the medicine bottle). The syringe and the medicine bottle are thus able to be coupled adjacently-in-series in the syringe holder cavity.

The medicine bottle neck clearance comprises a protrusion upwardly from the bottle and syringe guide holder housing; wherein the protrusion of the medicine bottle neck clearance comprises a rim-matching groove to accommodate a rim of the neck of the medicine bottle. The rim-matching groove prevents movement of the medicine bottle by securing the neck relative to the bottle and syringe guide holder housing. The open-ended half-cylindrical niche comprises a guide trough. The medicine bottle holder guide is located on a plane lower than the syringe holder cavity. The medicine bottle neck clearance is located between the medicine bottle holder guide and the syringe holder cavity.

The bottle and syringe guide holder housing comprises a rectangular parallelepiped profile in preferred embodiments (other shapes may be used in alternate embodiments) wherein the molded cavity comprises a negative portion removed from the bottle and syringe guide holder housing. The bottle and syringe guide holder housing comprises a planar bottom surface; wherein the planar bottom surface may comprise a gripper (gripping means) to prevent movement of the bottle and syringe guide holder housing relative to a resting-surface when used. The planar bottom surface is about 5¼ inches in length and 1⅝ inches in width in preferred embodiments such that the planar bottom surface comprises a sufficient footprint on the resting-surface to resist movement when used.

Plunger of the syringe is free to be manipulated with the plunger located outside of the confines of the bottle and syringe guide holder housing (to the side of); wherein a grip handle of a distal end of a barrel of the syringe abuts the bottle and syringe guide holder housing, a body of the barrel able to rest in the syringe holder cavity, a proximate end of the barrel located adjacent the medicine bottle holder guide, during use. The palm of a user is able to be placed over the barrel to hold the barrel in the syringe holder cavity, when used and/or the palm of the user is able to be placed over the barrel to hold the barrel in the syringe holder cavity, and over the medicine bottle, the medicine bottle thereby held in the medicine bottle holder guide. In this way the medicine bottle holder guide is useful for coupling the syringe and a neck of the medicine bottle and maintains the medicine bottle in a correct positioning relative to the syringe. This is especially handy for people with poor dexterity.

The medicine bottle neck clearance supports and holds the neck of the medicine bottle in alignment for a tip of the syringe to repeatedly and reliably enter the medicine bottle to extract insulin therefrom. Coupling of the syringe and medicine bottle in the bottle and syringe guide holder comprises an assistive device primarily for use by diabetics as a way of securing the syringe when sliding the medicine bottle up to meet the tip of the syringe in order to fill syringe with the insulin, and then to slide the medicine bottle back out.

A method of using a bottle and syringe guide holder system is also disclosed herein preferably comprising the steps of: sliding a syringe, with a needle end first, into a grooved channel located in a syringe holder cavity in a bottle and syringe guide holder housing ensuring that a grip handle of a distal end of a barrel of the syringe abuts the bottle and syringe guide holder housing; taking an insulin vial and sliding an inverted insulin vial along a medicine bottle holder guide making sure that a neck of the insulin vial faces the syringe; driving a needle directly into the insulin vial; retracting a plunger to fill the syringe with a proper insulin dosage; and removing the insulin vial. The method may further comprise the steps of leaving the syringe in the bottle and syringe guide holder housing until ready for administering a shot and then finally administering the shot of insulin.

The present invention holds significant improvements and serves as a bottle and syringe guide holder system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, bottle and syringe guide holder systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to an assistive device and more particularly to a bottle and syringe guide holder system as used to improve the coupling of a syringe and medicine bottle assistive device primarily for use by diabetics as a means of securing the syringe when sliding the bottle up to meet the syringe tip in order to fill it with insulin, and then slide the bottle back out.

Generally speaking, the bottle and syringe guide holder comprises a novel product offering consumers a practical solution to the aforementioned challenges. As the name implies, the bottle and syringe guide holder comprises a specially designed assistive device that is specially designed to couple a syringe and insulin bottle (or other medication bottle), providing a handy guide for needle insertion and extraction. Fabricated of a durable clear acrylic or plastic material, this product may basically be 3-D rectangular in shape, measuring approximately 5¼ inches in length and 1⅝ inches in width in preferred versions. Heights may vary.

Spanning the length of the device may be an open ended half-cylindrical niche, sized appropriately to completely house a standard, inverted insulin vial on one end, while the opposite end may accommodate the actual syringe. Positioned approximately in the center of the device directly below the niche utilized to secure the insulin bottle, may be a second, shorter and smaller half-cylindrical niche (arcuate groove) that serves as a clearance guide for coupling the insulin syringe and bottle neck. Positioned directly below the bottle neck guide may be a grooved holder, inside of which the user may insert the actual syringe. This opening may serve as a channel for a syringe, guiding a needle into the unit so that it slides unencumbered to meet the insulin vial at the bottom.

Figure 5:
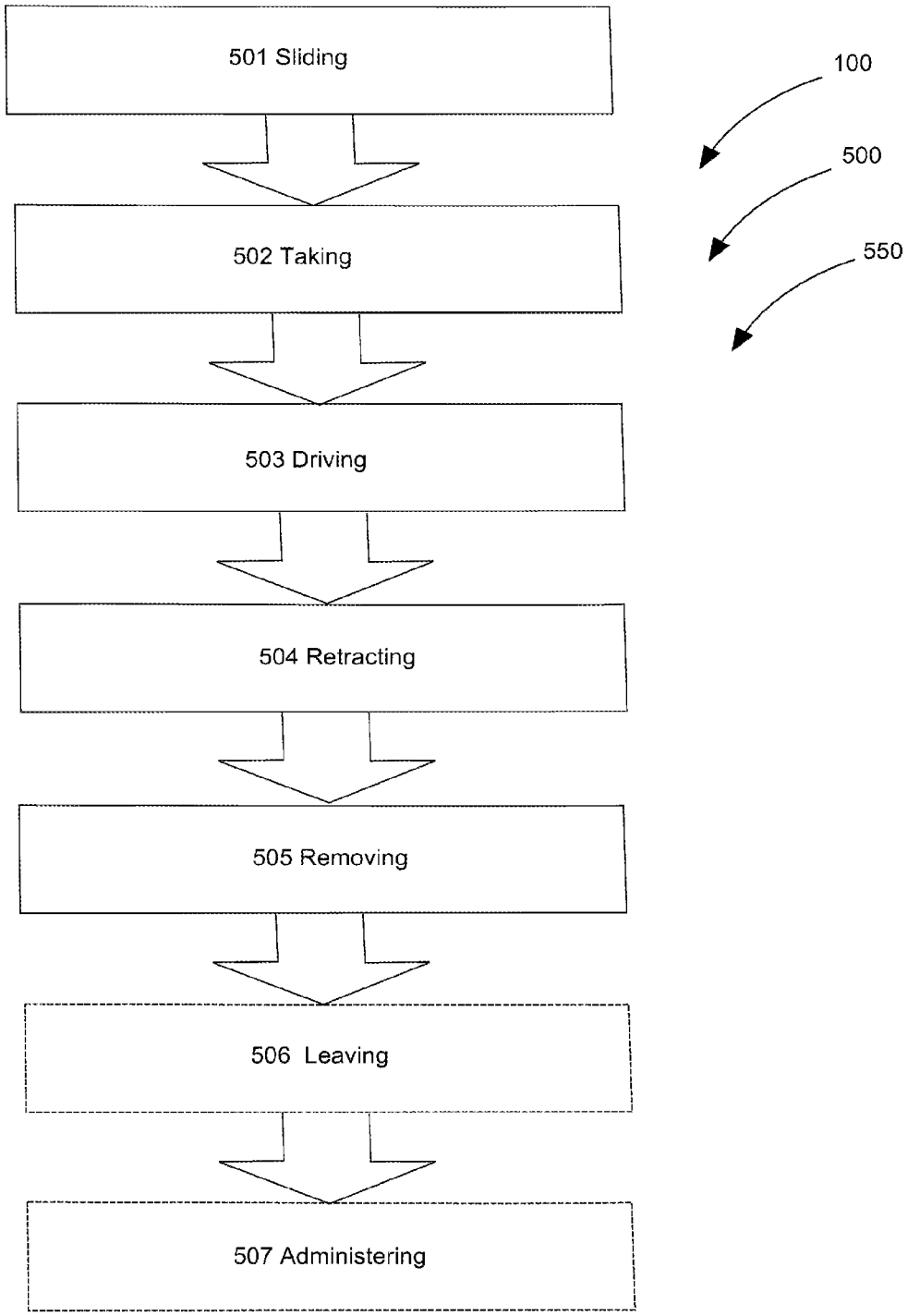
FIG. 5 is a flowchart illustrating a method of using the bottle and syringe guide holder system according to an embodiment of the present invention of FIGS. 1-4.

Use and application of the Bottle and Syringe Guide Holder may be relatively simple and straightforward. First, the user may slide a syringe, with the needle end first, into the grooved channel located at the proximal end of the bottle and syringe guide holder, making sure that the neck of the syringe rested in the unit's clearance guide. Taking an insulin vial from the refrigerator or other cool storage area, the user may then insert the inverted bottle within the large, cylindrical channel located at the distal end of the unit, making sure that the neck of the bottle faced the syringe positioned within the clearance guide. This action may drive the needle directly into its intended target. The user may then retract the plunger to fill the syringe with the proper insulin dosage, and then slide the bottle out; the syringe is filled and ready for administration. The insulin vial may then be stored away along with other medical supplies until again needed. FIG. 5 discusses a method of use in more detail.

There are several significant benefits and advantages associated with the present invention. Foremost, the Bottle and Syringe Guide Holder may provide diabetics with a more 'user-friendly' means of taking their needed medication. A convenient assistive device that joins a syringe and insulin vial, this apparatus may alleviate the many hassles that can be encountered when on an insulin regimen.

Eliminating the need to manually insert a needle into the top of an insulin vial, the bottle and syringe guide holder may provide a more simplified approach, via its handy channel system. In this manner, diabetics who suffer poor eyesight need not struggle to mate a needle with the insulin bottle's small ingress point, ending the risk that a needle will break or cause insulin spillage Importantly, those impacted by hand tremors, limited mobility or similar ailments may find the bottle and syringe guide holder an invaluable tool, allowing them to prepare their medication in a matter of seconds, without assistance. Sparing the user the painful needle jabs that can occur when filling a syringe with medication, the bottle and syringe guide holder may prove a practical safety tool when completing this necessary daily ritual. Compact and lightweight, the bottle and syringe guide holder may be comfortably carried anywhere, whether to work, to school, or to a beach or shopping excursion.

Ideal for general consumers use, this versatile product may find use with medical professionals and other health care providers. Made of durable, high-quality materials, the bottle and syringe guide holder is designed to withstand years of continued use, with ease. The bottle and syringe guide holder is an innovative product invention that may effectively foster peace of mind in diabetics who depend on insulin for their well-being and survival. Extremely easy to use, this product may offer instant accessibility to insulin whenever an injection is needed.

Injections may be given of insulin, as mentioned; however other medications may be dispensed from bottles into needles in a similar manner. Insulin is a peptide hormone, produced by beta cells of the pancreas, and is central to regulating carbohydrate and fat metabolism in the body. Insulin causes cells in the liver, skeletal muscles, and fat tissue to take up glucose from the blood. In the liver and skeletal muscles, glucose is stored as glycogen, and in adipocytes it is stored as triglycerides.

Insulin stops the use of fat as an energy source by inhibiting the release of glucagon. With the exception of the metabolic disorder diabetes mellitus and metabolic syndrome, insulin is provided within the body in a constant proportion to remove excess glucose from the blood, which otherwise would be toxic. When blood glucose levels fall below a certain level, the body begins to use stored sugar as an energy source through glycogenolysis, which breaks down the glycogen stored in the liver and muscles into glucose, which can then be utilized as an energy source. As a central metabolic control mechanism, its status is also used as a control signal to other body systems (such as amino acid uptake by body cells). In addition, it has several other anabolic effects throughout the body.

When control of insulin levels fails, diabetes mellitus can result. As a consequence, insulin is used medically to treat some forms of diabetes mellitus. Patients with type 1 diabetes depend on external insulin (most commonly injected subcutaneously) for their survival because the hormone is no longer produced internally. Patients with type 2 diabetes are often insulin resistant and, because of such resistance, may suffer from a "relative" insulin deficiency. Some patients with type 2 diabetes may eventually require insulin if other medications fail to control blood glucose levels adequately, as previously mentioned. Over 40% of those with Type 2 diabetes require insulin as part of their diabetes management plan creating a large demand for the present invention described herein.

Referring now to the drawings more specifically using numerals of reference there is shown in FIGS. 1-4, various views of bottle and syringe guide holder system 100 according to embodiment(s) of the present invention.

Bottle and syringe guide holder system 100 preferably comprises bottle and syringe guide holder housing 110. Bottle and syringe guide holder housing 110 comprises molded cavity 120 having open-ended half-cylindrical niche 130, syringe holder cavity 140; medicine bottle holder guide 160; and medicine bottle neck clearance, shown in an in-use condition 150 in FIG. 1.

Figure 1:
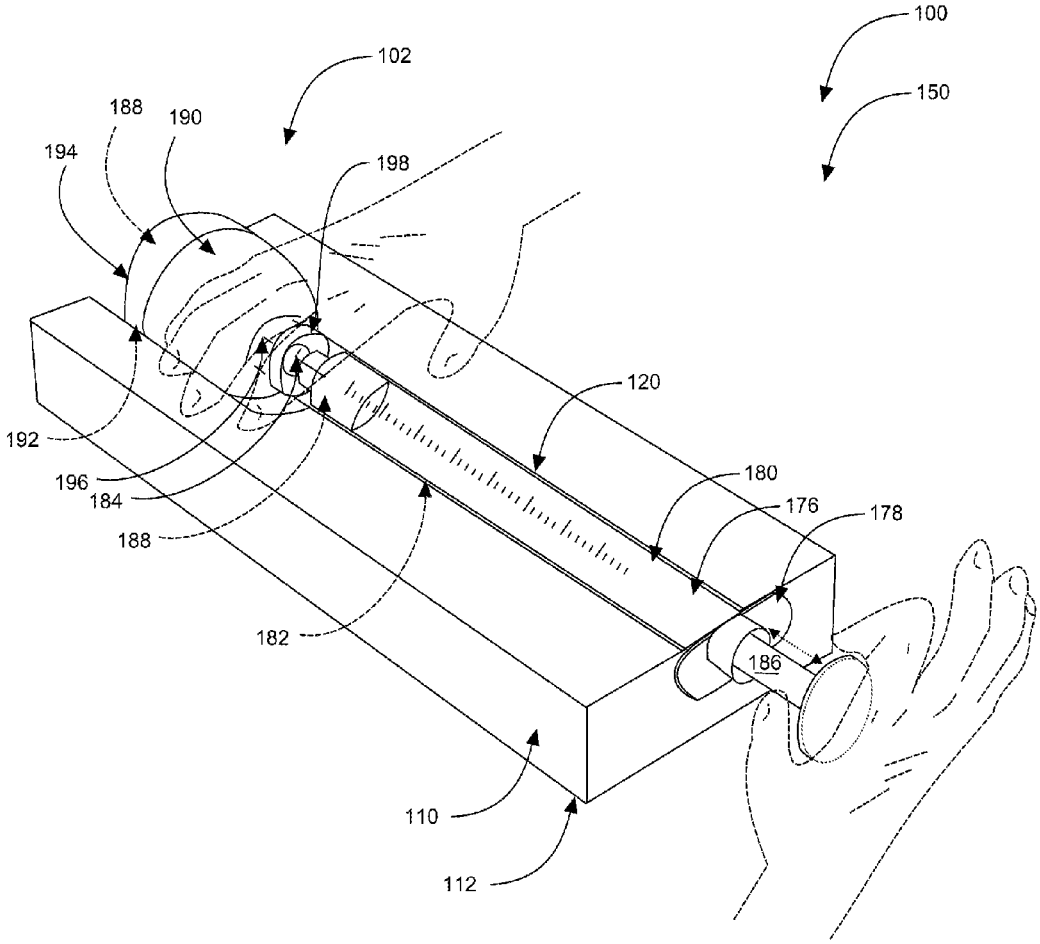
FIG. 1 shows a perspective view illustrating a bottle and syringe guide holder system in an in-use condition according to an embodiment of the present invention.

Bottle and syringe guide holder housing 110 comprises molded cavity 120; molded cavity 120 comprises formed indentation 122 to hold secure syringe-side-volume 182 of syringe 180, and bottle-side-volume 192 of medicine bottle 190, syringe 180, and medicine bottle 190 set into formed indentation 122 to be temporarily held in stasis, as shown in FIG. 1. Open-ended half-cylindrical niche 130 is shown sized to allow a standard (inverted) insulin vial 194 to be slid in at one end, while an opposite end accommodates syringe 180 (needle 184) to be inserted into insulin vial 194, insulin vial 194 comprising medicine bottle 190. As such, syringe 180 and medicine bottle 190 are able to be coupled adjacently-in-series in syringe holder cavity 140. Syringe 180 and medicine bottle 190 are able to be coupled adjacently-in-series (FIGS. 1 & 3) such that needle 184 may puncture and enter into medicine bottle 190. Thus, medicine bottle holder guide 160 is useful for coupling syringe 180 and neck 196 of medicine bottle 190 and maintains medicine bottle 190 in a correct positioning relative to syringe 180. Medicine bottle neck clearance supports and holds neck 196 of medicine bottle 190 in alignment for a tip of needle 184 of syringe 180 to repeatedly and reliably enter medicine bottle 190 (through lid) to extract insulin 188 therefrom.

Coupling of syringe 180 and medicine bottle 190 in bottle and syringe guide holder housing 110 comprises assistive device 102 primarily for use by diabetics (or care-givers) as a way (means) of securing syringe 180 when sliding medicine bottle 190 up to meet and accept tip of needle 184 of syringe 180 in order to fill syringe 180 with insulin 188, and then slide medicine bottle 190 back out. Bottle and syringe guide holder housing 110 comprises clear acrylic in preferred embodiments. Other suitably equivalent materials may be used.

Figure 2:
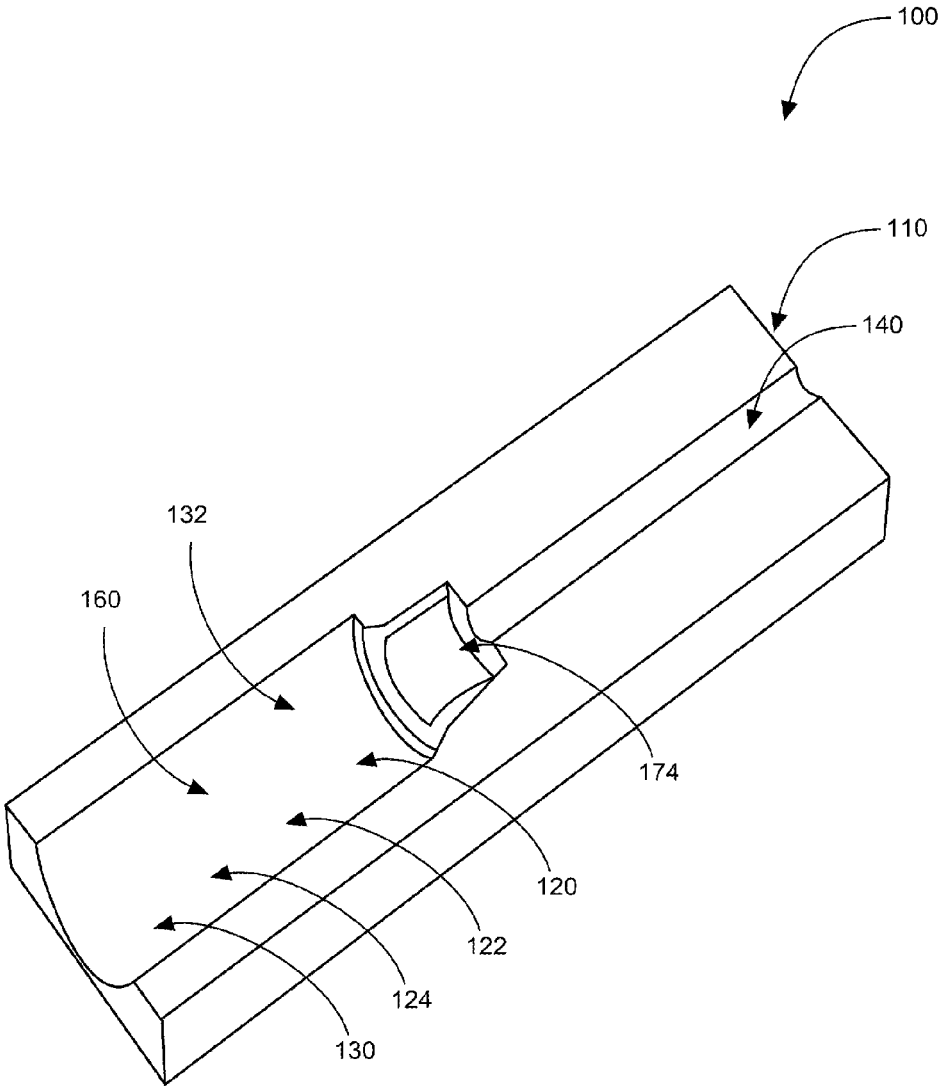
FIG. 2 is a perspective view illustrating an empty bottle and syringe guide holder housing of the bottle and syringe guide holder system according to an embodiment of the present invention of FIG. 1.
Figure 3:
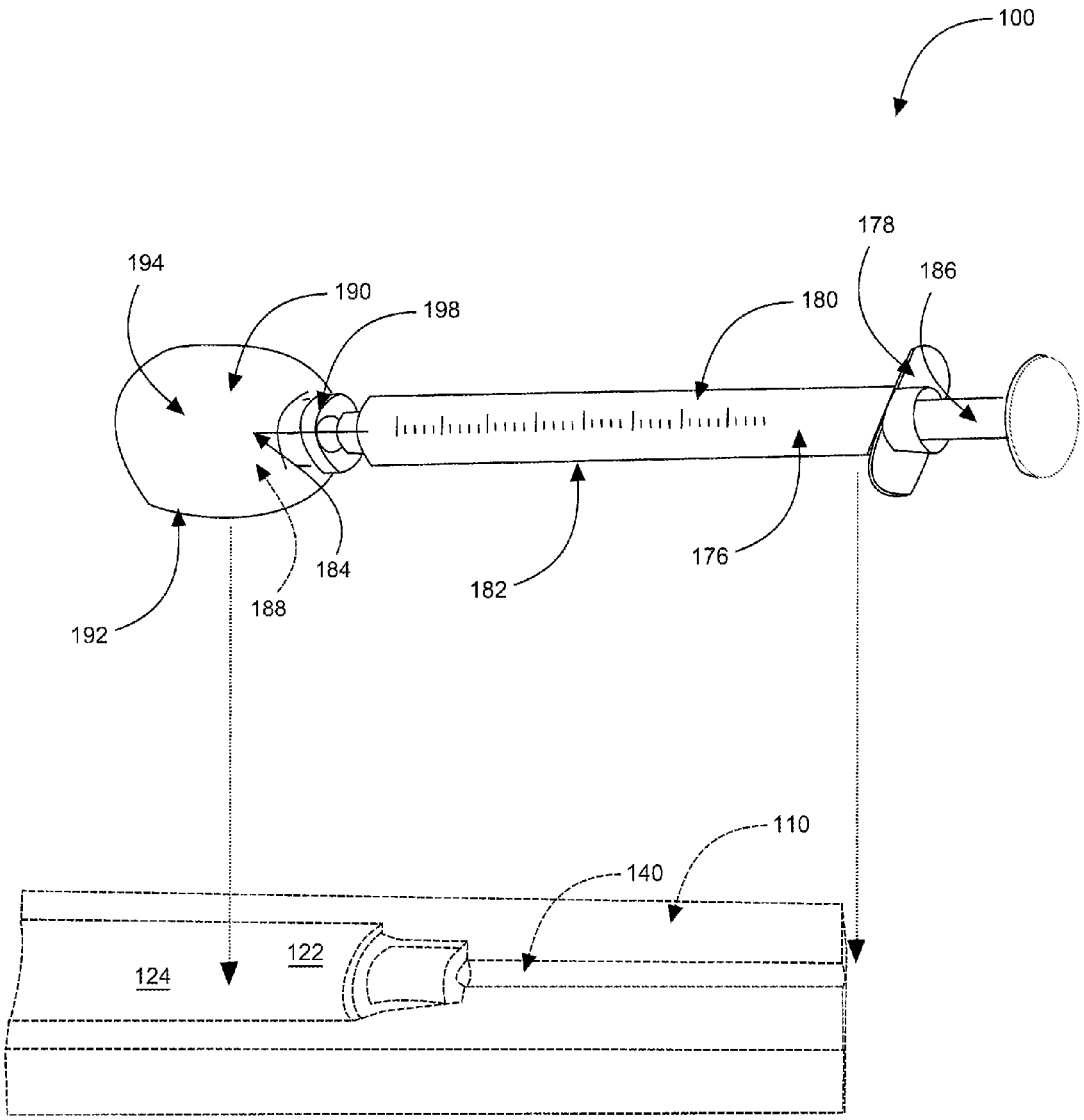
FIG. 3 is an exploded view illustrating the bottle and syringe guide holder housing (as occupied) of the bottle and syringe guide holder system according to an embodiment of the present invention of FIG. 1.
Figure 4:
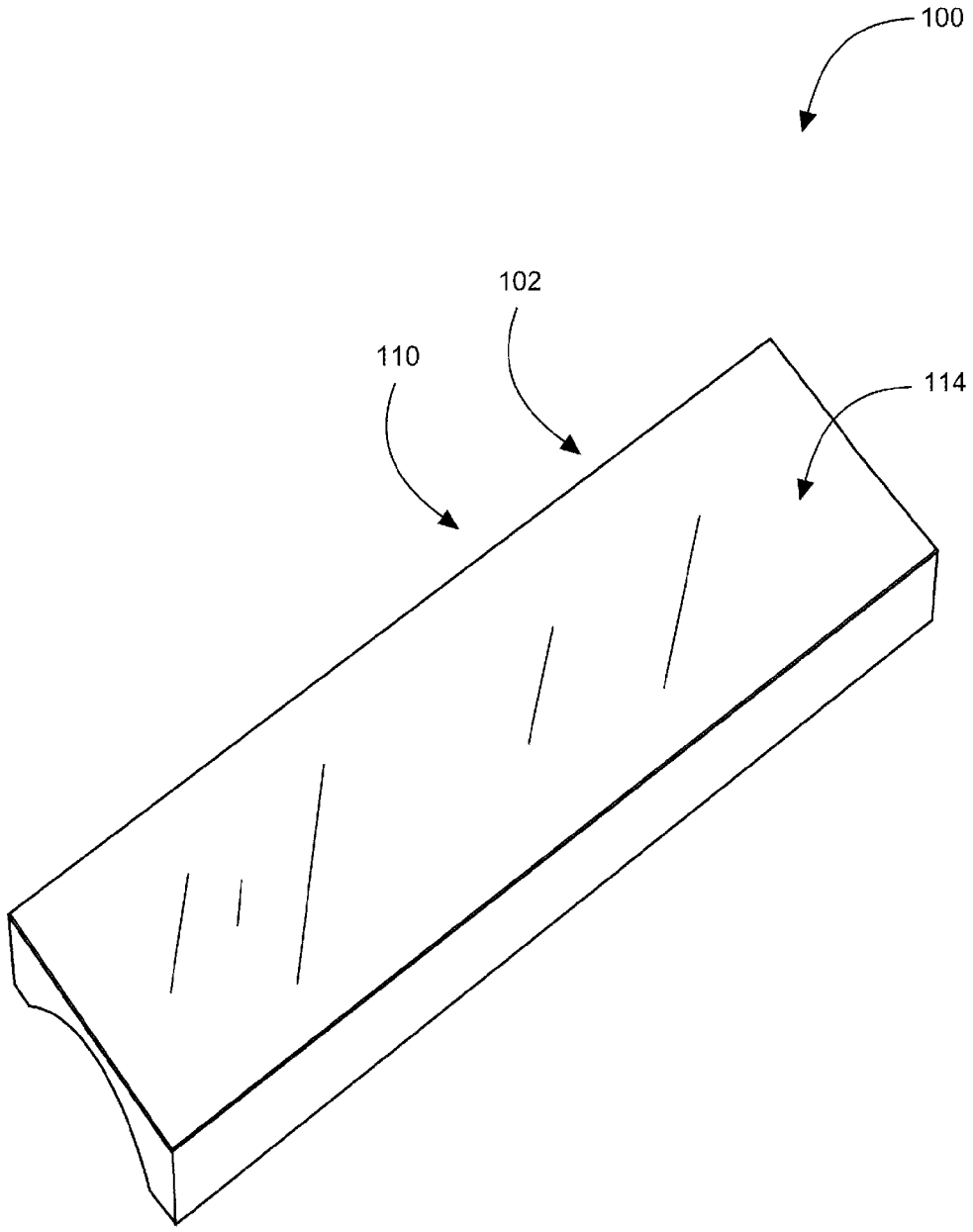
FIG. 4 is a bottom view illustrating the bottle and syringe guide holder housing of the bottle and syringe guide holder system according to an embodiment of the present invention of FIG. 1.

Medicine bottle neck clearance comprises rim-matching groove 174 to accommodate rim 198 of neck 196 of medicine bottle 190, as shown in FIGS. 1-2. Rim-matching groove 174 prevents movement of medicine bottle 190 by securing neck 196 (via rim 198) relative to bottle and syringe guide holder housing 110. Open-ended half-cylindrical niche 130 comprises guide trough 132. FIG. 3 shows bottle and syringe guide holder housing 110 without medicine bottle 190 and syringe 180 inserted such that an indication is shown how medicine bottle 190 and syringe 180 (in series-combination) are able to be set in bottle and syringe guide holder housing 110 to be held steady for use.

Putting the present invention in perspective relationally speaking, medicine bottle holder guide 160 is located on a plane lower than syringe holder cavity 140. Medicine bottle neck clearance is located between medicine bottle holder guide 160 and syringe holder cavity 140. Molded cavity 120 is formed in bottle and syringe guide holder housing 110, as such.

Bottle and syringe guide holder housing 110 of bottle and syringe guide holder system 100 preferably comprises a rectangular parallelepiped profile (volume) wherein molded cavity 120 comprises a negative portion 124 removed from bottle and syringe guide holder housing 110 during manufacturing. Given its substantially rectangular parallelepiped profile, bottle and syringe guide holder housing 110 comprises planar bottom surface 112. Planar bottom surface 112 may comprise a gripper 114 (frictioning means) to prevent movement of bottle and syringe guide holder housing 110 relative to a resting-surface (such as a desk, table, countertop or the like) when used. Planar bottom surface 112 (shown in FIG. 4) is about 5¼ inches in length and 1⅝ inches in width, as previously mentioned, such that planar bottom surface 112 comprises a sufficient footprint on resting-surface to frictionally resist movement when used. Assistive device 102 is compact in size so that it is readily portable, yet durable in construction and relatively inexpensive to produce.

Plunger 186 of syringe 180 is free to be manipulated; plunger 186 located outside of confines (past the end) of bottle and syringe guide holder housing 110, as shown in FIG. 1. This may be accomplished since grip handle 178 of a distal end of a barrel 176 of syringe 180 abuts (against) bottle and syringe guide holder housing 110, a body of barrel 176 able to rest in syringe holder cavity 140, a proximate end of barrel 176 located adjacent medicine bottle holder guide 160, during use.

In this way a palm of a user is able to be placed over barrel 176 to hold barrel 176 in syringe holder cavity 140, when used. Alternately, to hold the present invention during use the palm of the user is able to be placed over barrel 176 to hold barrel 176 steady in syringe holder cavity 140, and over medicine bottle 190, medicine bottle 190 held in medicine bottle holder guide 160, as shown in FIG. 1, while manipulating plunger 186.

Referring now to FIG. 5, flowchart 550 illustrating method of using 500 bottle and syringe guide holder system 100 according to an embodiment of the present invention of FIGS. 1-4.

Method of using 500 bottle and syringe guide holder system 100 comprising the steps of: step one 501 sliding syringe 180, with a needle end (tip of needle 184) first, into a grooved channel located in syringe holder cavity 140 in bottle and syringe guide holder housing 110 ensuring that a grip handle 178 of a distal end of barrel 176 of syringe 180 abuts bottle and syringe guide holder housing 110; step two 502 taking insulin vial 194 and sliding an inverted insulin vial 194 along medicine bottle holder guide 160 making sure that neck 196 of insulin vial 194 faces syringe 180; step three 503 driving needle 184 directly into insulin vial 194; step four 504 retracting plunger 186 to fill syringe 180 with a proper insulin dosage (of insulin 188); and step five 505 removing insulin vial 194.

The method 500 may further comprise the steps of step six 506 leaving syringe 180 in bottle and syringe guide holder housing 110 until ready for step seven 507 administering a shot and administering shot of insulin 188.

It should be noted that steps 506 and 507 are optional steps and may not be implemented in all cases. Optional steps of method 500 are illustrated using dotted lines in FIG. 5 so as to distinguish them from the other steps of method 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A bottle and syringe guide holder system comprising:

a) a bottle and syringe guide holder housing comprising a molded cavity having;
   i) an open-ended half-cylindrical niche;
   ii) a syringe holder cavity;
   iii) a medicine bottle holder guide; and
   iv) a medicine bottle neck clearance;

b) wherein said bottle and syringe guide holder housing comprises said molded cavity, said molded cavity comprises a formed indentation to hold secure a syringe-side-volume of a syringe, and a bottle-side-volume of a medicine bottle, said syringe, and said medicine bottle set into said formed indentation to be temporarily held in stasis;

c) wherein said open-ended half-cylindrical niche is sized to allow a standard inverted insulin vial to be slid in at one end, while an opposite end accommodates said syringe to be inserted into said insulin vial, said insulin vial comprising said medicine bottle;

d) wherein said bottle and syringe guide holder completely house the standard inverted insulin vial;

e) wherein said bottle and syringe guide holder housing comprises a rectangular parallel-piped structure;

f) wherein said bottle and syringe guide holder housing is structured and arranged with a planar bottom surface, said planar bottom surface is further structured and arranged with a frictional gripper for frictional gripping and a resting-surface to prevent movement of said planar bottom surface and relative to said resting-surface;

g) wherein said planar bottom surface is about 5¼ inches in length and 1⅝ inches in width such that said planar bottom surface comprises a sufficient footprint on said resting-surface to resist movement when used;

h) wherein said syringe and said medicine bottle are able to be coupled adjacently-in-series in said syringe holder cavity;

i) wherein said medicine bottle holder guide is useful for coupling said syringe and a neck of said medicine bottle and maintains said medicine bottle in a correct positioning relative to said syringe;

j) wherein said medicine bottle neck clearance supports and holds a neck of said medicine bottle in alignment for a tip of a needle of said syringe to repeatedly and reliably enter said medicine bottle to extract insulin therefrom; and k) wherein coupling of said syringe and medicine bottle in said bottle and syringe guide holder housing comprises an assistive device primarily for use by diabetics as a way of securing said syringe when sliding said medicine bottle up to meet said tip of said needle of said syringe in order to fill said syringe with said insulin, and then slide said medicine bottle back out.

* * * * *